US006065768A

United States Patent [19]

Lee

[11] Patent Number: 6,065,768

[45] Date of Patent: May 23, 2000

[54] SNOWBOARD BINDER

[75] Inventor: Jong Gu Lee, Seoul, Rep. of Korea

[73] Assignee: Ellim Corporation Limited, Kyunggy-do, Rep. of Korea

[21] Appl. No.: 09/030,479

[22] Filed: Feb. 25, 1998

[30] Foreign Application Priority Data

Jul. 15, 1997 [KR] Rep. of Korea ..... P97-32815

[51] Int. Cl.[7] ..... A63C 9/00

[52] U.S. Cl. ..... 280/613; 280/14.2; 280/607; 280/618

[58] Field of Search ..... 280/14.2, 11.14, 280/607, 613, 618, 626

[56] References Cited

U.S. PATENT DOCUMENTS

| | | | |
|---|---|---|---|
| 5,028,068 | 7/1991 | Donovan | 280/618 |
| 5,505,477 | 4/1996 | Turner et al. | 280/613 |
| 5,520,406 | 5/1996 | Anderson et al. | 280/624 |
| 5,577,755 | 11/1996 | Metzger et al. | 280/607 |
| 5,690,350 | 11/1997 | Turner et al. | 280/613 |
| 5,732,959 | 3/1998 | Soejima | 280/14.2 |
| 5,755,046 | 5/1998 | Dodge | 36/117.3 |
| 5,765,853 | 6/1998 | Erb | 280/607 |
| 5,820,155 | 10/1998 | Brisco | 280/607 |
| 5,890,729 | 4/1999 | Bayer et al. | 280/618 |
| 5,954,358 | 9/1999 | Bejean et al. | 280/14.2 |

*Primary Examiner*—J. J. Swann
*Assistant Examiner*—Christopher D Bottorff
*Attorney, Agent, or Firm*—Ladas & Parry

[57] ABSTRACT

A snowboard binder for removably securing a boot onto a snowboard. The snowboard binder includes a bail mounted on a bottom surface of a boot having a set of locking rods on its both ends, a base disposed on the snowboard having a set of loop-type hooks formed to respectively receive each of locking rods on both ends of thereof, and a latch device for removably securing one of the locking rods within a set of bracket extended upward from the base spaced apart from each other in the proximity of one of the loop-type hooks. An angle adjust device for conveniently controlling the angle of the base is also provided.

14 Claims, 9 Drawing Sheets

SNOWBOARD BINDER

BACKGROUND OF THE INVENTION

1. Field of the Invention

The present invention relates to a snowboard binder and, more particularly, to a snowboard binder for removably securing a boot to a snowboard.

2. Description of the Prior Art

Snowboarding is a recent popular leisure sport, in which a binder is used to removably mount snowboard boots on a snowboard. Normally, a user dismounts the boots from a snowboard to carry the snowboard around a skiing area, and mounting it on the snowboard by means of a binder in preparation for snowboarding.

FIG. 1 shows a snowboard binder according to the prior art. The snowboard binder has a frame fixed on a snowboard, a supporting member combined with the frame to support the rear part of a boot ankle, and several bands for removably fastening the boot to the frame and the supporting member.

The user must dismount his boots from the snowboard before riding a lift which carries the user to a starting point for snowboarding. After arriving at the starting point, he must again mount his boots on the snowboard. The mounting and dismounting of the snowboard boots are frequent and the binder of FIG. 1 causes the problem that it is inconvenient to the, user to mount or dismount the boots using this type of binder and also the bands are easily unfastened as the user snowboards.

Moreover, the user can selectively put his left foot or the right foot on the forepart of a snowboard according to the user's taste and preference. Therefore, a mount angle of a binder should be variable so that the binder can removably secure a boot to the snowboard while allowing a fine and convenient configuration of the angle of the binder.

SUMMARY OF THE INVENTION

In order to achieve the above objects, a snowboard binder for removably securing a boot on a snowboard according to the present invention comprises, a bail having a set of locking rods at both ends, said bail being mountable on a bottom surface of the boot; a base disposed on said snowboard with a set of loop-type hooks formed to receive said locking rods and a latch device for removably securing one of the locking rods within a set of spaced brackets extending upward from said base in proximity to one of the loop-type hooks.

Another feature of the snowboard binder according to the present invention comprises, a pivot shaft for the latch device; a latch member with a lock receiving groove extending downward from a cam surface to lock said locking rod, said latch member being rotatably mounted to allow said locking rod to enter one of the loop-type hooks when one of the locking rods pushes against said cam surface, said latch member being provided with said cam surface at an upper portion thereof; a torsion spring disposed so that said lock receiving groove locks said locking rod within said loop-type hook after said locking rod passes said cam surface; and a lever whose bottom end is rotatably connected to an upper end of said latch member so that said latch member unlocks said locking rod, said lever being slidably and rotatably engaged in slots in the shaft between the brackets.

Still another feature of the snowboard binder according to the present invention is that a first hole is formed at a center portion of the base, a plurality of radial protruding portions are formed at the periphery of a mount flange, and the snowboard binder further comprises an angle adjust device having an angle adjust plate engaging said snowboard with a plurality of engaging grooves along a lower periphery thereof which engage said radial protruding portions.

A further feature of the snowboard binder according to the present invention includes a base with a plurality of radial protruding portions formed at a periphery of a mount flange having a first hole at a middle portion thereof, said snowboard binder having a bail removably mountable at a bottom surface of a boot, said snowboard binder comprising, a substrate attached on said snowboard and having a center shaft, said substrate being received within said first hole; an angle adjust plate vertically movable along said center shaft and having a plurality of grooves engaging said radial protruding portion; and a resilient member disposed between said substrate and said angle adjust plate to press said angle adjust plate upward; and an angle adjust device with a lock handle interlocked with said center shaft so that said angle adjust plate and said substrate are engaged or disengaged by clockwise or counter-clockwise rotation of said lock handle.

A still further feature of a snowboard binder for removably securing a boot onto a snowboard according to the present invention comprises, a bail with a set of locking rods at a front end and a rear end thereof, said bail being mountable at a bottom surface between a toe portion and a heel portion of said boot; a base having a first loop-type hook and a second loop-type hook, said base being placed on said snowboard, a front locking rod being received in said first loop-type hook by entering a front end of the base substantially forward, a rear locking rod being received in said second hook by entering a rear end of the base substantially downward; and a latch device for removably securing one of the locking rods within a set of spaced brackets extending upward from said base proximity to one of the loop-type hooks.

BRIEF DESCRIPTION OF THE DRAWINGS

The objects and advantages of the present invention will be more clearly understood to those skilled in the art with reference to the accompanying drawings in which.

DETAILED OF THE PREFERRED EMBODIMENT

The present invention will now be described in detail referring to the accompanying drawings.

Figure 1:
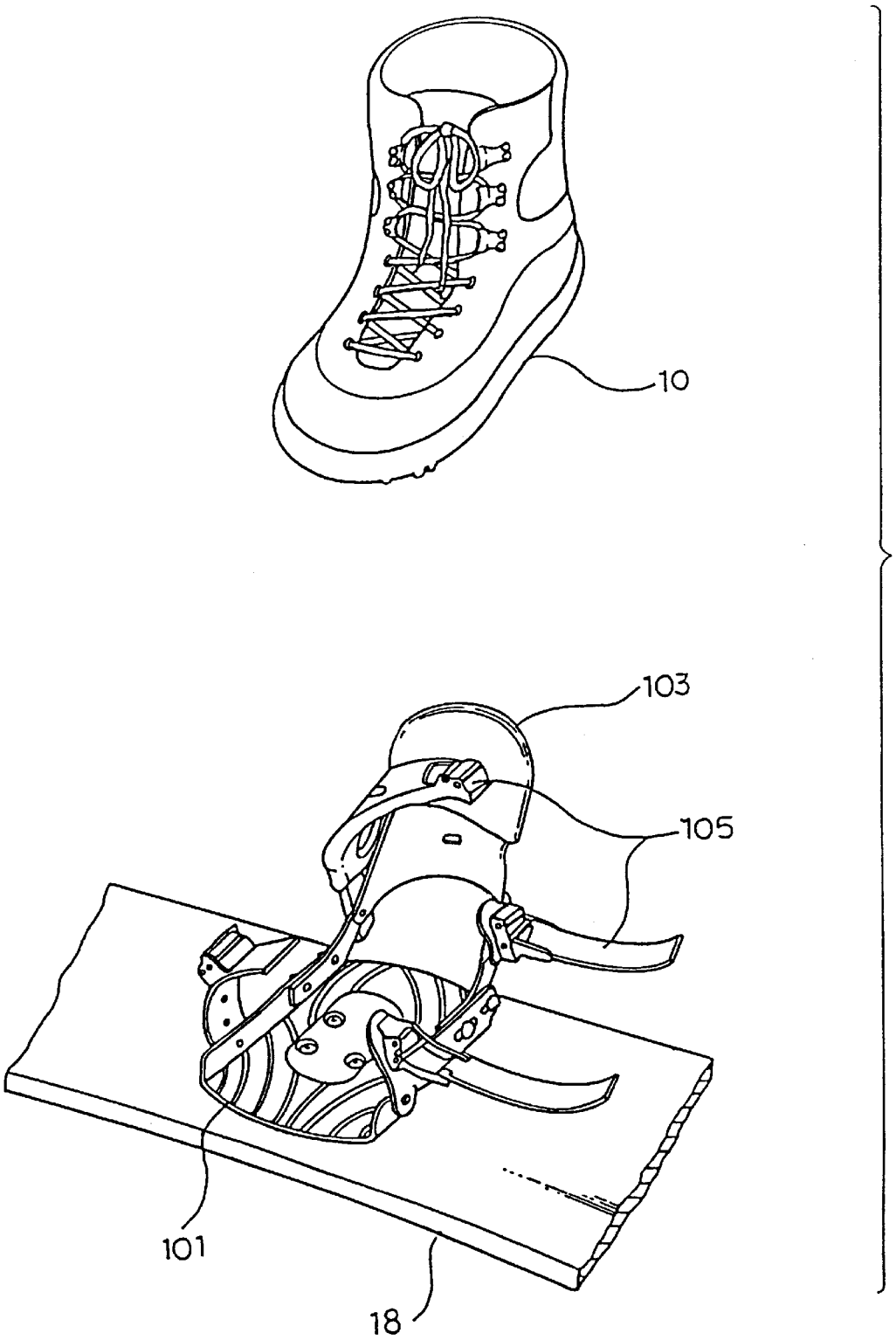
FIG. 1 PRIOR ART
FIG. 1 is a schematic perspective view of a snowboard binder of the prior art.
Figure 2:
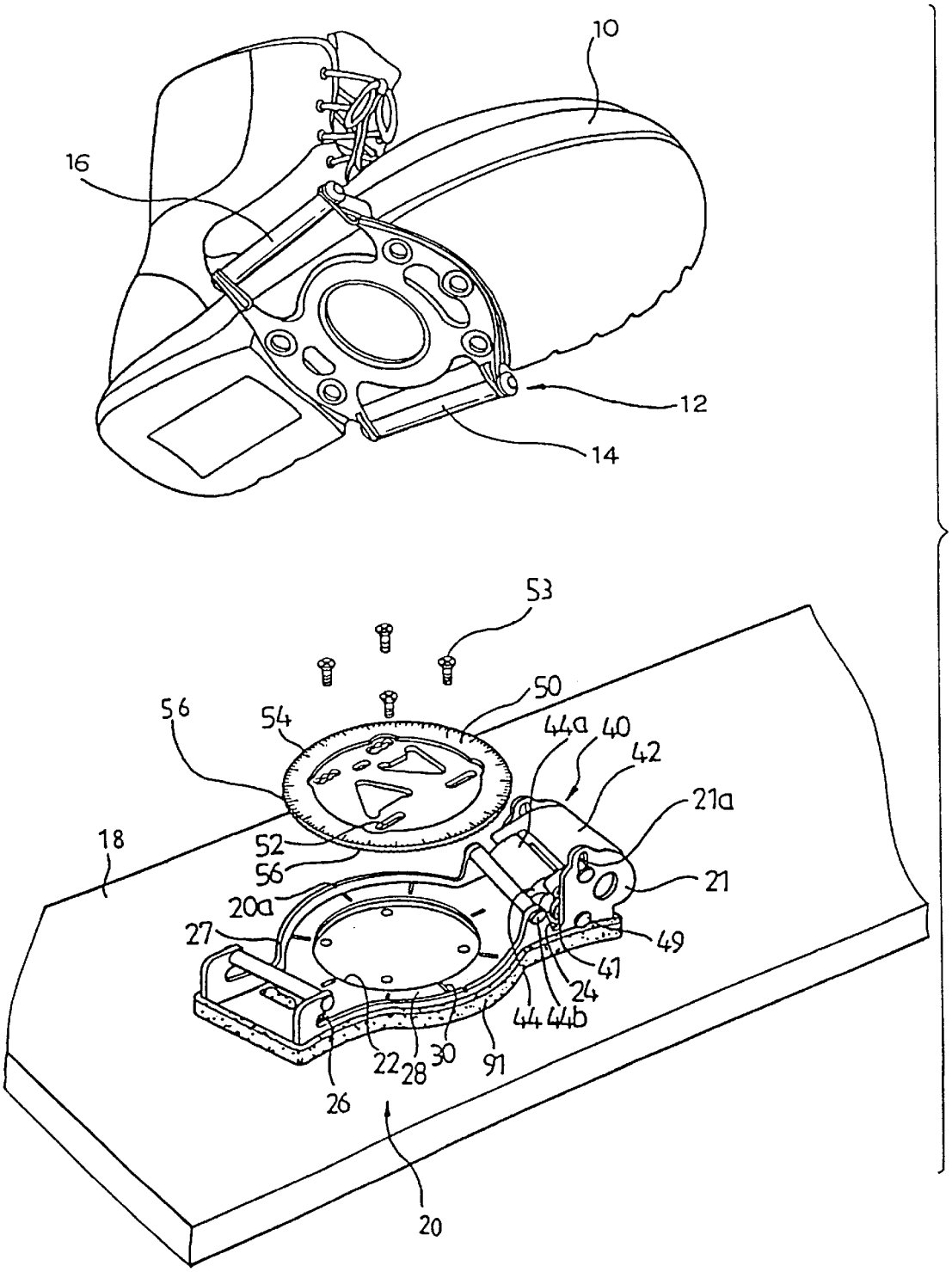
FIG. 2 is an exploded perspective view of an embodiment of a snowboard binder and an angle adjust device according to the present invention.
Figure 3:
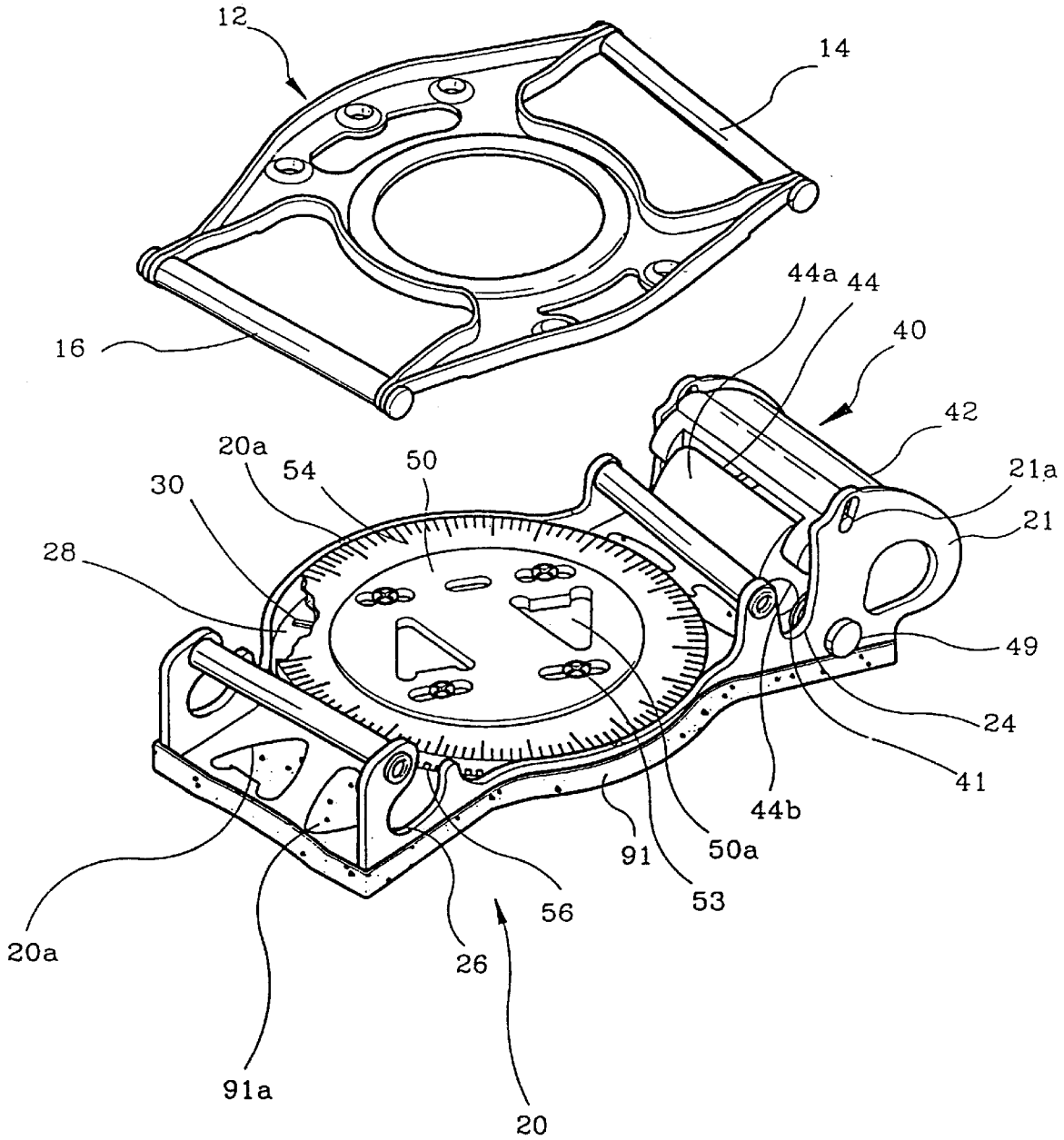
FIG. 3 is an enlarged perspective view showing the state of the angle adjust device engaging a base.

In FIG. 2 and FIG. 3, an embodiment of a snowboard binder according to the present invention is illustrated. The snowboard binder comprises a bail 12 mounted laterally on a bottom surface of a boot 10, a base 20 removably securing said bail thereto, and a latch device 40 at a side of said base 20. At both ends of the bail 20, a set of locking rods 14, 16 are provided. The locking rods 14, 16 are each received within loop-type hooks 24, 26 formed on the base 20 and then the locking rod 14 is removably secured by the latch device 40. One of the locking rods, that is the locking rod 14 which is locked by the locking device 40, is rotatably installed within the bail 12. In proximity to the loop-type hook, a pair of spaced brackets 21 extend upward from the base 20. The base 20 is disposed on a snowboard 18, and a first hole 22 is formed at a center portion thereof. At the periphery of a mounting flange 28 which defines the first hole 22, a plurality of protrusion portions 30 are provided. In order to reinforce the protrusion portions 30, a rib 27 is bent upward at the base 20. A plurality of engaging grooves 56 which are formed along the periphery of a lower surface of an angle adjust plate 50 engages the protrusion portion 30. The angle adjust plate 50 engaged as above interlocks snowboard 18 by means of a screw 53 through a second hole 52. Thereby, the base 20 is mounted on the snowboard 18. A plurality of cavities 50*a* are formed in the angle adjust plate 50 to reduce its weight. At the upper surface of the angle adjust plate 50, a scale 54 is provided. The scale 54 is preferably provided with 1° spacing to allow a fine angle adjustment. Also, an index 20*a* is provided on the base 20 to indicate the angle configuration. A cushion member 91 is disposed between the base 20 and the snowboard 18. The cushion member 91 is of a shape corresponding to a periphery of the base 20. At base 20, a plurality of engaging holes 20*b* are formed. At the engaging holes 20*b*, an engaging protrusion portion 91*a* protrudes from the cushion member 91 to ensure secure engagement of the base 20 and the cushion member 91.

In order to change the mount angle of the base 20, the screw 53 is released for a certain length and the angle adjust plate 50 is raised upward. In this state, the angle of the base 20 is changed and then the angle adjust plate 50 is lowered engaging the protrusion portion 30 and the engaging groove 56. Then, the screw 53 is tightened to securely mount the base 20 to the snowboard 18.

The latch device 40 comprises a pivot shaft 49 disposed between the brackets 21, a lever 42, a latch member 44 unlocking the locking rod 14 by raising the lever 42, and a torsion spring 41. In the upper portion of the latch member 44, a cam surface 44*a* is formed. Below the cam surface 44*a*, a lock receiving groove 44*b* extending downward from the cam surface 44*a* is formed. The torsion spring 41 is disposed so that after the locking rod 14 passes said cam surface 55*a*, the lock receiving groove 44*b* locks the locking rod 14 within the loop-type hook 24. The lever 42 is rotatably and slidably engaged within slots 21*a* formed in brackets 41. A lower end of the lever 42 is rotatably connected to an upper end of the latch member 44 so that the latch member 44 unlocks the locking rod 14 when the lever 42 is pulled substantially upward.

Figure 4A:
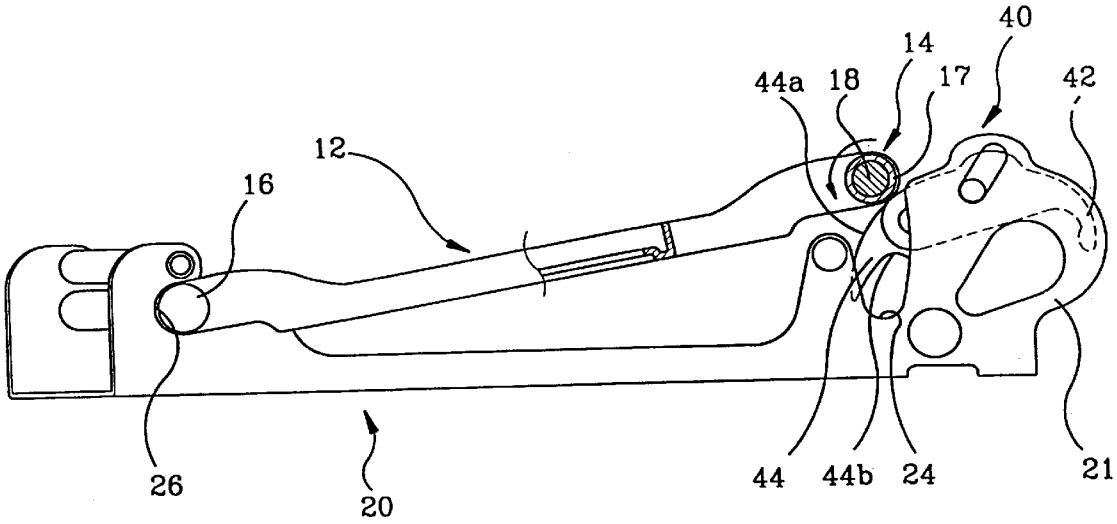
FIGS. 4A and FIGS. 4B together provide a side view of lock or unlock movement of the snowboard binder according to the embodiment of the present invention.
Figure 4B:
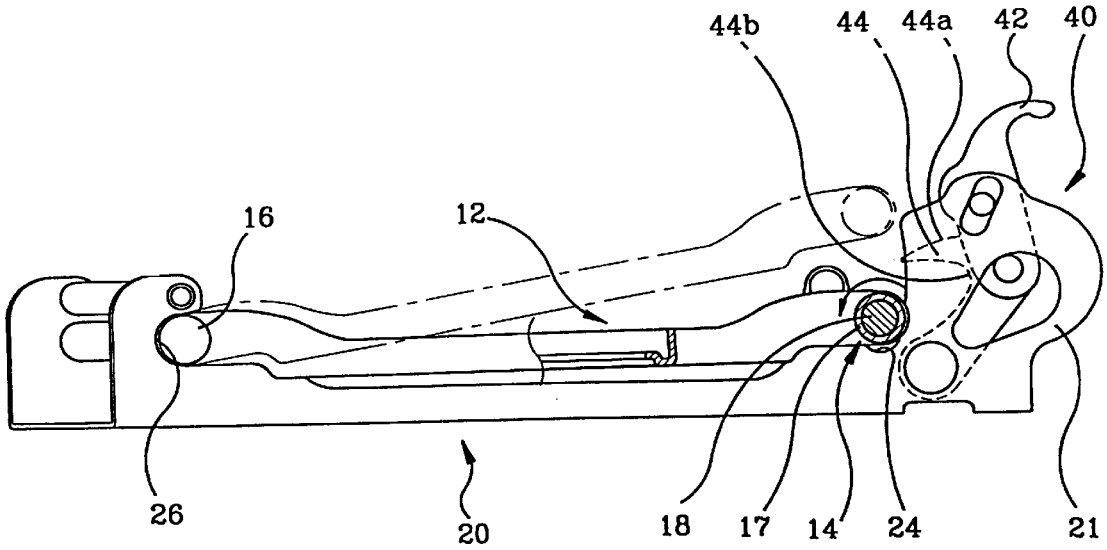
Figure 5:
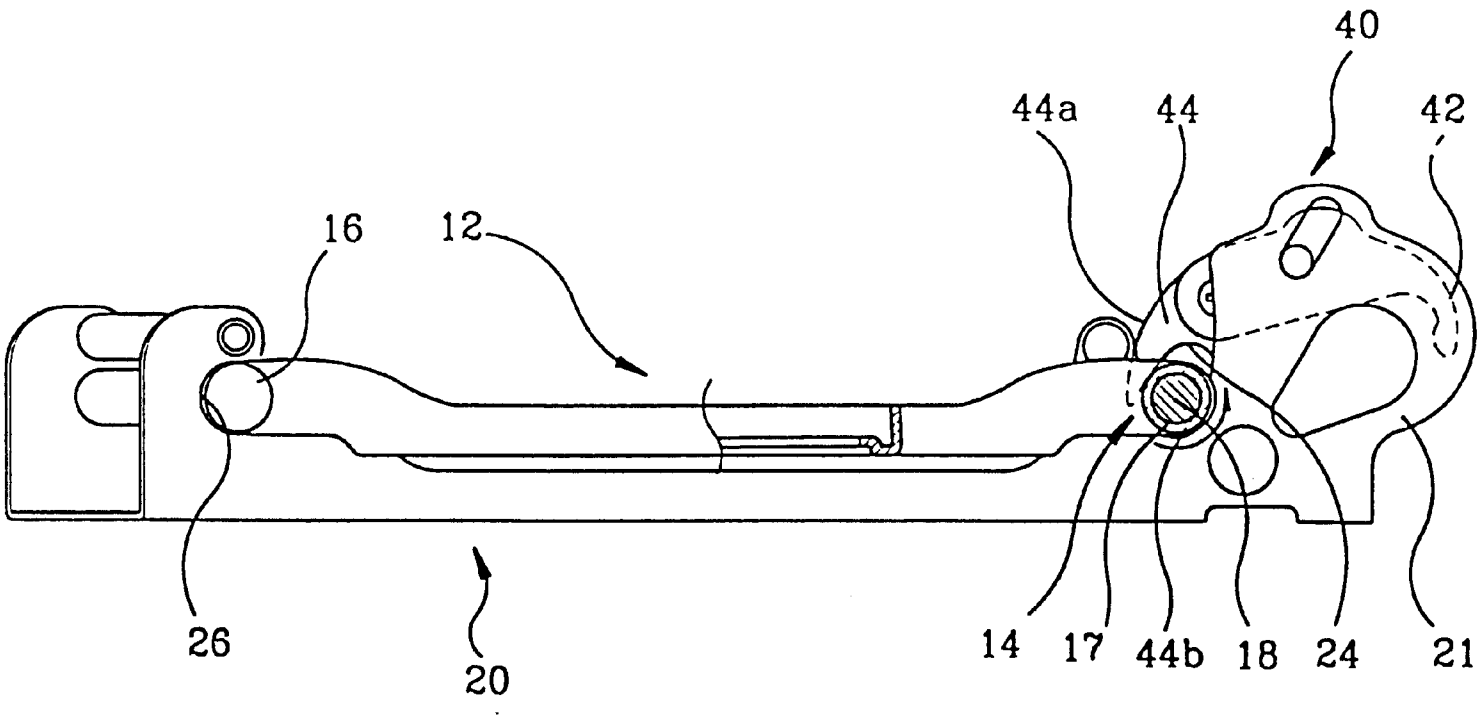
FIG. 5 is a side view showing the locked state of the snowboard according to the embodiment of the present invention.

As can be seen in FIG. 4A, FIG. 4B and FIG. 5, after inserting the loop-type hook 26 onto the locking rod 16 substantially in the lateral direction, the latch member 44 is rotated clockwise about the pivot shaft 49 when locking rod 14 presses against the cam surface 44*a* of the latch member 44. After the latch member 44 is rotated further, the locking rod 14 enters the loop-type hook 24. Simultaneously, the latch member 44 is rotated counterclockwise by the torsion spring 41. Therefore, the locking rod 14 is locked within the loop-type hook 24 by means of the lock receiving groove 44*b* as can be seen from FIG. 5. In order to separate the locking rod 14 from the loop-type hook 24, the lever 42 is raised substantially upward. This makes the latch member 44 rotate in the clockwise direction, and the locking rod 14 can be separated from the latch device.

Figure 6:
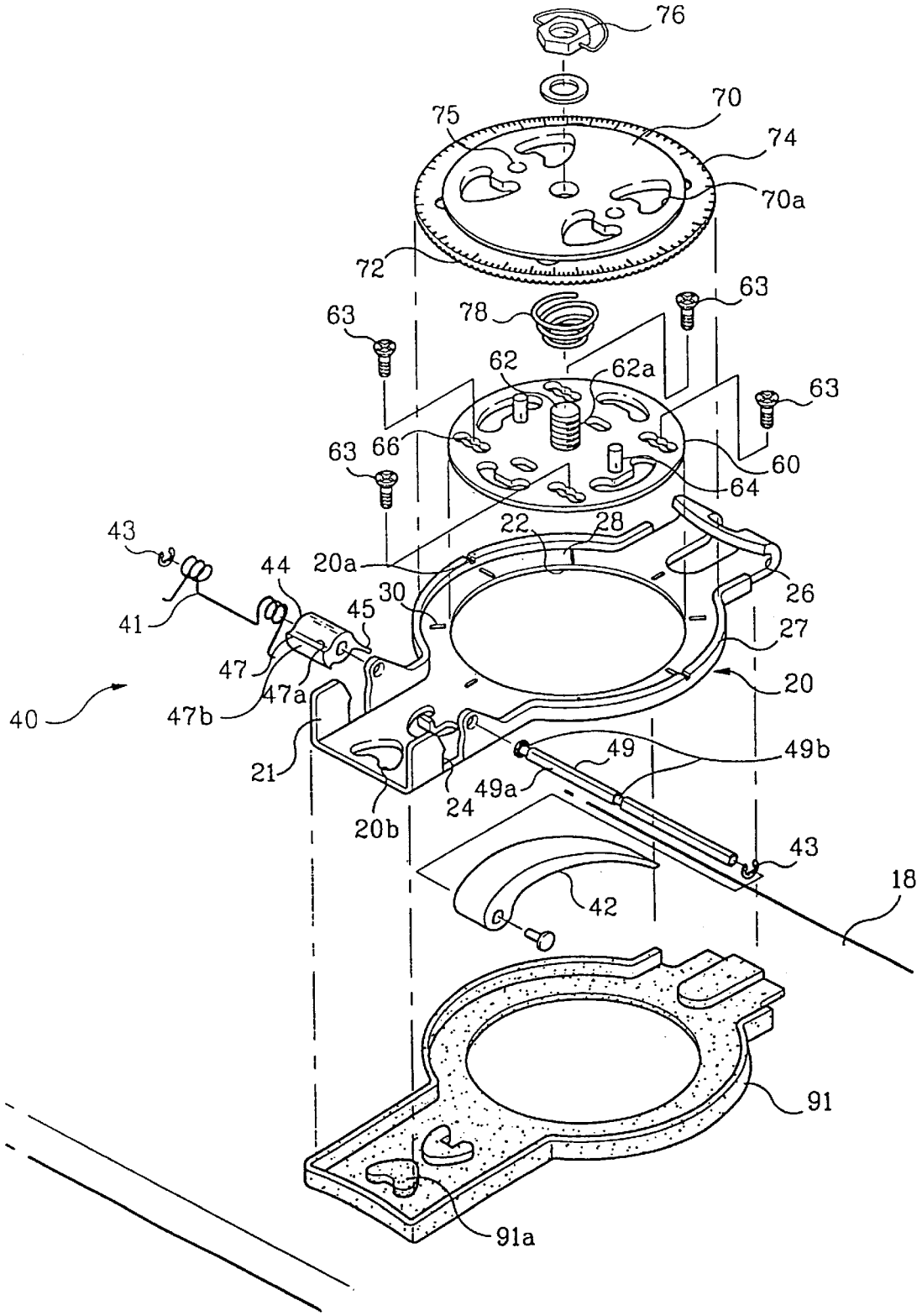
FIG. 6 is an exploded perspective view showing another embodiment of an angle adjust device and a latch device of the snowboard binder according to the present invention.

In FIG. 6, another embodiment of the angle adjust device of the snowboard binder is illustrated. In an upper portion of a substrate, a center shaft 62 is provided. An outer radius of the substrate 60 is smaller than an inner radius of the first hole 22. A second hole 66 is formed in the substrate 60 for mounting on the snowboard 18. The substrate 60 interlocks the snowboard 18 by means of a screw 63 through a second hole 66. A thread portion 62*a* is formed at an upper portion of the center shaft 62. The angle adjust plate 70 is assembled so that a vertical movement of the center shaft 62 is possible. A plurality of engaging grooves 72 is formed along the periphery of a lower surface of the angle adjust plate 70. An engaging groove 72 engages a protruding portion 40 formed on the mount flange 28 of the base 20. A scale 74 is provided at the upper surface of the angle adjust plate 70. The scale 74 is preferably provided with 1° spacing to allow a fine angle adjustment. A resilient cushion member 78 is disposed between the substrate 60 and the angle adjust plate 70 to exert an upward force. The resilient member 78 is substantially in the shape of a conical spring. The resilient member 78 is disposed around the center shaft 62 so that it does not deviate. A lock handle 76 interlocks the thread portion 62*a* at an upper portion of the angle adjust plate 70. A set of guide holes 75 is formed in the angle adjust plate 70. A set of guide shafts 64 engaging the guide holes 75 are provided on the substrate 60 to guide the vertical movement of the angle adjust plate 70.

Figure 7:
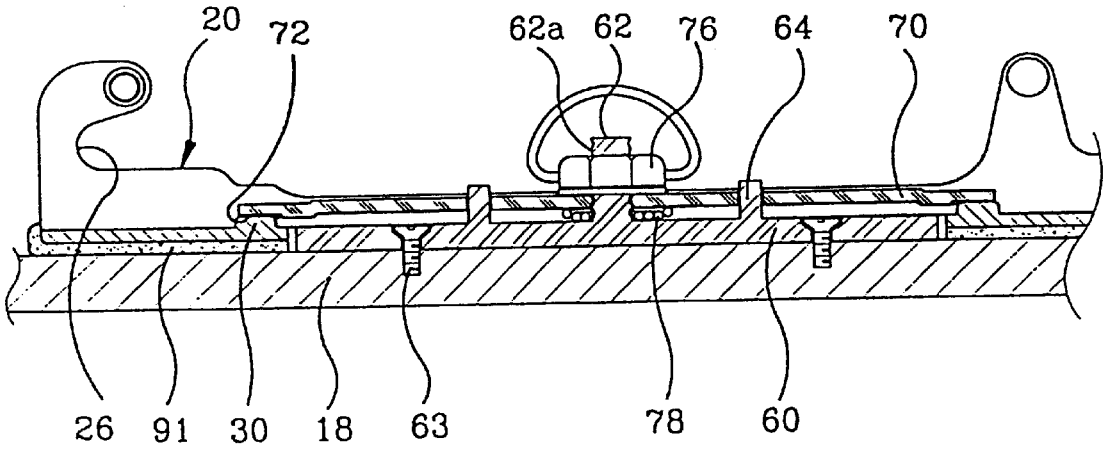
FIG. 7 is a cross-sectional view showing the state of the angle adjust device of FIG. 6 engaging the base.

FIG. 7 illustrates the base 20 secured by means of the angle adjust device of FIG. 6. As can be seen from the figure, the protrusion portion 30 engages the engaging groove 56 and the locking handle 76 is turned clockwise. Therefore, the base is securely fixed to the snowboard 18.

Figure 8:
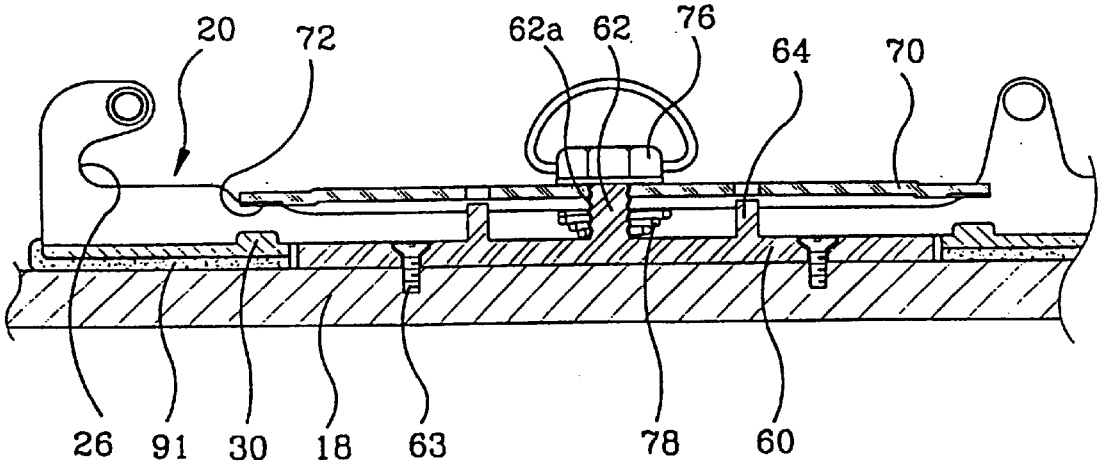
FIG. 8 is a cross-sectional view showing the state of an angle adjust plate being dismounted from a substrate in order to control the angle of the base by using the angle adjust device of FIG. 6.

When adjusting the angle of the base 20, the lock handle 76 is turned counterclockwise as illustrated in FIG. 8. Here, the angle adjust plate 70 is separated upward from the substrate 60 by means of the resilient member 78. In this state, the base 20 can be rotated simply. After rotating the base 20 for a certain angle, the protruding portion 30 and the engaging groove 56 are engaged and the lock handle 76 is tightened. When the angle adjust plate 70 moves vertically on the substrate 60, the angle adjust plate 70 is prevented from rotating because the angle adjust plate 70 is guided by the guide shaft 64. Therefore, the angle configuration can be more easily performed. An index 20*a* provided on the base 20 enables a more accurate and easy configuration.

Figure 9:
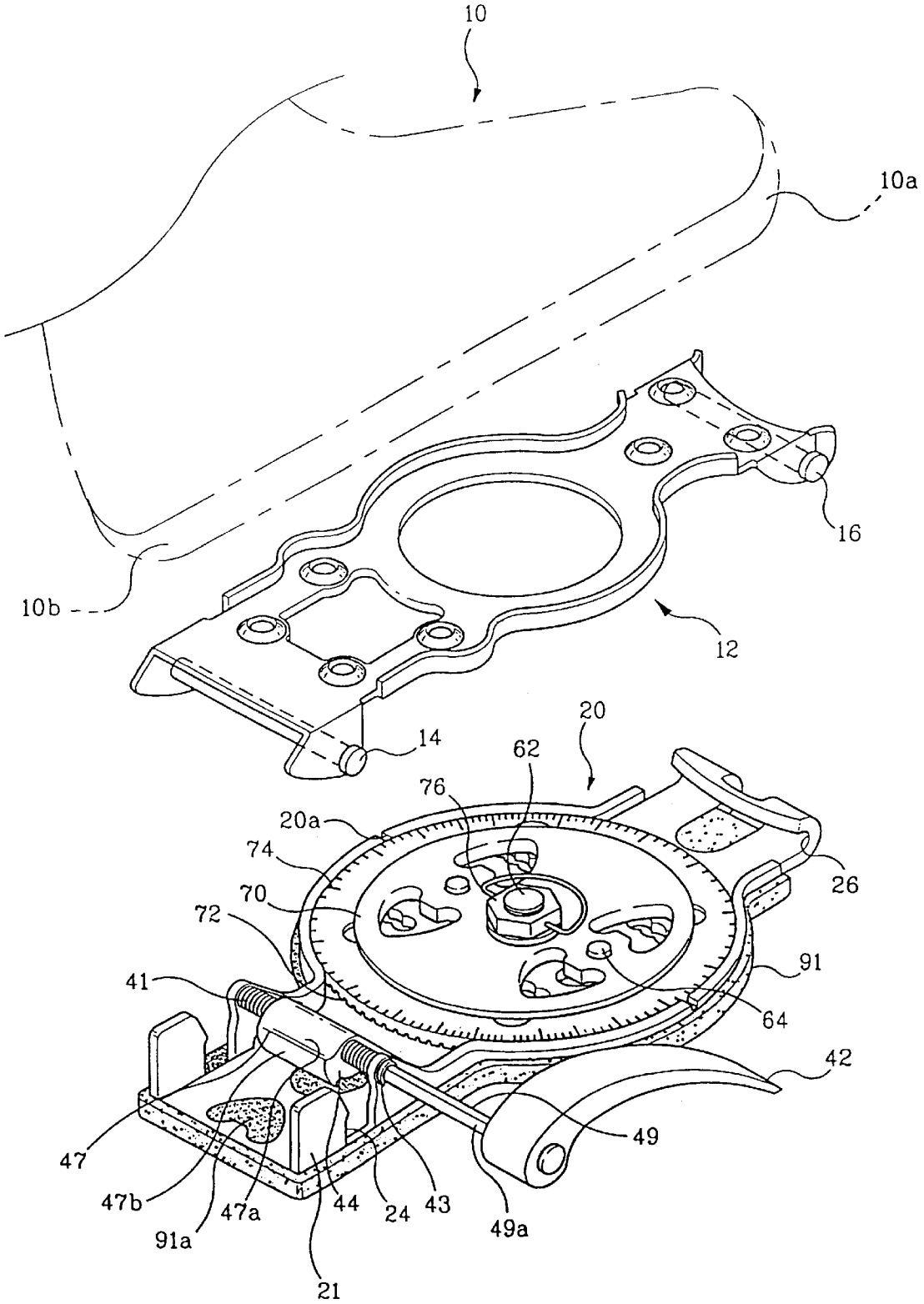
FIG. 9 is a perspective assembly view showing another embodiment, shown in FIG. 6, of an angle adjust device and a latch device of the snowboard binder according to the present invention.

FIG. 9 illustrates another embodiment of the snowboard binder and the latch device. The snowboard binder comprises a bail 12 mountable on the bottom surface of the boot 10, and a base 20 for removably securing the bail 12 thereto. The bail 12 is mounted at the bottom of the boot 10 between a toe portion 10*a* and the heel 10*b* of the boot. A set of locking rods 14, 16 are provided at both ends of the bail 12. After the locking rods 14, 16 are received within loop-type hooks on the base 20, locking rod 14 is removably secured by the latch device 40.

At a front end of the base 20, the locking rod 16 which is closer to the toe portion 10*a* of the boot 10 enters substantially in the forward direction in first loop-type hook 26. The second hook 24, in which the locking rod 14, close to the heel 10*b* of the boot 10, enters, is formed at a rear end of the base 20. The base 20 is placed on the snowboard 18 (refer to FIG. 6) and the cushion member 91 is disposed between the base 20 and the snowboard 18. The cushion member 91 has a shape surrounding the periphery of the bottom of the base. The rear locking rod 14 is rotatably mounted in the bail 12. A plurality of engaging holes 20*b* are formed in the base 20. The engaging protrusion portion 91*a* engages the engaging hole 20*b* in order to secure engagement between the base 20 and the resilient member 91. In proximity to the loop-type hook 24 of the base, the set of spaced brackets 21 extends upward on the base. The pivot shaft 49 engages the brackets 21 rotatably. Interlocking rings 43 engage collars 49*b*(refer to FIG. 6) formed as grooves in the pivot shaft 49 to prevent the pivot shaft 49 from deviating in the brackets 21. One end of the pivot shaft 49 extends outward from the brackets 21, and a lever 42 is provided at the extended portion in order to prevent the pivot shaft 49 from deviating in the brackets 21. The lever 42 can be integrated with the pivot shaft 49. The latch member 44 engages the pivot shaft 49 between the brackets so that the pivot shaft 49 rotates with the lever 42. The latch member 44 engages a cut surface 49*a* which is cut in the longitudinal direction. A stopper 45 supported on the base 20 is formed at one end of the latch member 44. A cam 47 abutting against a rear side locking rod 14 is formed at the opposite side of the stopper 45. An ascending cam surface 47*a* is formed at an upper portion and a descending cam surface 47*b* is formed at a lower portion of the cam 47. One side of the torsion spring 41 is supported by a lower side of the cam 47 so that the stopper 45 of the latch member 44 presses against the base 20. Another side of the torsion spring 41 is preferably supported by the loop-type hook 24.

Figure 10:
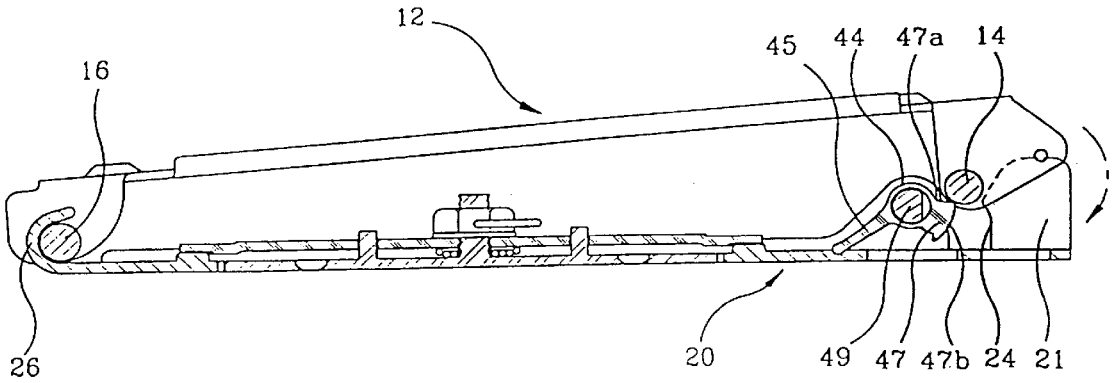
FIG. 10 is a cross-sectional view showing the state of a locking rod of a bail entering the latch device of FIG. 9.
Figure 11:
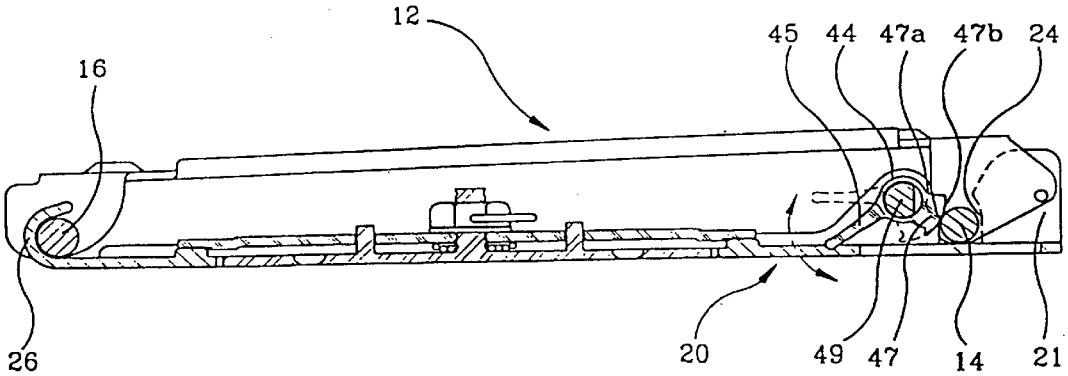
FIG. 11 is a cross-sectional view showing the state of the locking rod of the bail being locked in the latch device of FIG. 9.

As can be seen from FIG. 10, after engaging substantially forward a front locking rod 16 of the bail 12, locking rod 14 is disposed in loop-type hook 24. Thereafter, when the locking rod 14 is stepped on, the rear side of the locking rod 14 rotates the cam 47 downward sliding on the ascending cam surface 47*a* of the cam 47. When the rear locking rod 14 passes the ascending cam surface 47*a* and abuts against the descending cam surface, the cam 47 is returned upward by means of the torsion spring 47. Therefore, the rear locking rod 14 is pressed by the descending cam surface 47*b* while being received within the loop-type hook, hence preventing the loop-type hook 24 from deviating.

On the other hand, the lever 42 can be installed at the left side of the pivot shaft 49(opposite the location illustrated in FIG. 9) to separate the locking rod 14 when the lever 42 is pressed.

The lever 42 is raised to separate the bail 12 from the base 20, rotating the pivot shaft 49 downward, that is in counterclockwise direction. When the cam 47 is rotated downward, the locking rod leaves the descending cam surface 47*b*, enabling the locking rod 14 to depart from the loop-type hook 24.

As can be seen, the snowboard binder according to the present invention can be easily mounted and dismounted on the snowboard and the angle of the base can be easily adjusted.

What is claimed is:

1. A snowboard binder for removably securing a boot on a snowboard comprising:

a bail having ends and a set of locking rods at said ends, said bail being mountable on a bottom surface of the boot;

a base disposed on said snowboard, said base having a set of loop-type hooks formed to receive said locking rods; and a latch device for removably securing one of the locking rods in a respective one of said loop-type hooks within a set of spaced brackets extending upward from said base in proximity to said one of the loop-type hooks, said latch device comprising:

a pivot shaft disposed between the brackets;

a latch member having a cam surface at an upper portion thereof and a lock receiving groove extending downward from said cam surface to lock said one of said locking rods in said one of the loop-type hooks, said latch member being rotatable mounted on said pivot shaft to allow said one of said locking rods to enter one of the loop-type hooks when said one of the locking rods pushes against and past said cam surface, a torsion spring disposed so that said groove locks said one of said locking rods within said loop-type hook after said one of said locking rods passes said cam surface; and a lever having a bottom end rotatable connected to an upper end of said latch member so that said latch member can unlock said one of said locking rods, said lever being slidably and rotatably engaged within slots formed in the brackets.

2. The snowboard binder of claim 1, wherein a first hole is formed at a center portion of the base, a plurality of radial protruding portions being formed on a periphery of a mounting flange defining said first hole, and further comprising an angle adjust device comprising an angle adjust plate engaging said snowboard, said angle adjust plate having at plurality of engaging grooves along a periphery thereof which engage said radial protruding portions.

3. The snowboard binder of claim 1, further comprising a cushion member between the base and the snowboard, said cushion member being shaped to correspond to a periphery of said base.

4. The snowboard binder of claim 1, wherein said latch member is secured to said pivot shaft, said pivot shaft being rotatably engaged within the brackets.

5. A snowboard binder removably securing one locking rod of a set of locking rods, placed at both ends of a bail mountable at a bottom surface of a boot, with a loop-type hook formed at a side of a base mountable on a snowboard, said snowboard binder comprising:

a pivot shaft disposed between a set of brackets on said base, a latch member having a cam surface at an upper portion thereof and a lock receiving groove extending downward from said cam surface to lock said one locking rod, said latch member being rotatably mounted on said pivot shaft to allow said one locking rod to enter the loop-type hook when said one locking rod pushes against and past said cam surface;

a torsion spring disposed so that said lock receiving groove locks said one locking rod within said loop-type hook after said one locking rod passes said cam surface; and a latch device comprising a lever having a bottom end rotatably connected to an upper end of said latch member so that said latch member can unlock said one locking rod, said lever slidably and rotatably engaging within slots formed in the brackets.

6. The snowboard binder of claim 5, wherein said latch member is secured to said pivot shaft, said pivot shaft being rotatably engaged within the brackets.

7. The snowboard binder of claim 5, wherein a first hole is formed at a center portion of the base, a plurality of radial protruding portions being formed at a periphery of a mounting flange, said periphery of the mounting flange defining said first hole and further comprising an angle adjust device comprising an angle adjust plate engageable with said snowboard, said angle adjust device having a plurality of engaging grooves along a periphery thereof which engage said radial protruding portions.

8. The snowboard binder of claim 5, further comprising cushion member shaped to correspond to a periphery of said base and disposed between said base and said snowboard.

9. A snowboard binder for removably securing a boot onto a snowboard comprising:

a bail including a set of locking rods at a front end and a rear end thereof, said bail being mountable at a bottom surface of a boot between a toe portion and a heel portion of said boot;

a base comprising first and second loop-type hooks, said base being mountable on said snowboard, a front one of said locking rods being received in said first loop-type hook by entering a front end of the base substantially forwardly, a rear one of said locking rods being received in said second loop-type hook by entering a rear end of the base substantially downwardly; and a latch device for removably securing one of the locking rods in a corresponding one of said loop-type hooks within a set of spaced brackets extending upward from said base in proximity to said one of the loop-type hooks, said latch device including a pivot shaft rotatably supported in said brackets, said pivot shaft having a cut surface, said latch device including a latch member engaging said cut surface so that said latch member rotates when said pivot shaft rotates.

10. The snowboard binder of claim 9, wherein the rear locking rod is interlocked by means of said latch device, said rear locking rod being rotatably installed within said bail.

11. The snowboard binder of claim 9, further comprising:

a lever disposed at one end of said pivot shaft extending outward from said brackets;

the latch member having a stopper supported by said base at one end thereof, and a cam abutting against said one of said locking rods, said latch member being mounted on said pivot shaft between the brackets so that said latch member rotates with said pivot shaft as said lever rotates, and a torsion spring having one end supported to press said latch member in a direction so that said stopper presses against said base and another end supported by said base so that said one of said locking rods passes an ascending cam surface and is received below a descending cam surface when said one of said locking rods presses against said cam.

12. The snowboard binder of claim 11, wherein said lever is integrated with said pivot shaft.

13. A snowboard binder having a base with a plurality of radial protruding portions formed on a periphery of a mount flange with a first hole at a middle portion thereof, said snowboard binder having a bail removably mountable on a bottom surface of a boot, said base being mountable on a snowboard, said snowboard binder comprising:

a substrate attachable on said snowboard and having a center shaft, said substrate being received within said first hole;

an angle adjust plate vertically movable along said center shaft, said angle adjust plate having a plurality of engaging grooves engaging said plurality of radial protruding portions; and a resilient member disposed between said substrate and said angle adjust plate to press said angle adjust plate upward; and an angle adjust device with a lock handle interlocked with said center shaft at an upper end thereof so that said angle adjust plate and said substrate are engaged or disengaged by clockwise or counter-clockwise rotation of said lock handle.

14. The snowboard binder of claim 13, wherein a set of guide holes are formed in said angle adjust plate, and further comprising a set of guide shafts on said substrate in the set of guide holes in order to guide vertical movement of said angle adjust plate.

* * * * *